US005174452A

United States Patent [19]

Wang

[11] Patent Number: 5,174,452

[45] Date of Patent: Dec. 29, 1992

[54] PICNIC SANDWICH BOX

[76] Inventor: Paul S. Wang, 13620 Benson Ave., Chino, Calif. 91710

[21] Appl. No.: 747,004

[22] Filed: Aug. 19, 1991

[51] Int. Cl.[5] ..... B65D 43/02; B65D 51/28

[52] U.S. Cl. ..... 206/542; 206/549; 220/318; 220/521

[58] Field of Search ..... 206/541-549, 206/553; 220/94 R, 318, 377, 521, 522, 529, 530, 908

[56] References Cited

U.S. PATENT DOCUMENTS

| | | | |
|---|---|---|---|
| 2,555,788 | 6/1951 | Donaldson | 206/545 |
| 3,278,074 | 10/1966 | Yamazaki | 220/94 R |
| 3,624,787 | 11/1971 | Newman | 220/522 |
| 3,679,093 | 7/1972 | Chang | 220/522 |
| 4,216,875 | 8/1980 | Stanish | 220/522 |
| 4,691,840 | 9/1987 | Ferbrache | 220/318 |
| 4,819,827 | 4/1989 | Disesa | 220/318 |
| 4,830,190 | 5/1989 | Inagaki | 206/545 |
| 4,930,637 | 6/1990 | Deroseau | 220/521 |
| 5,009,310 | 4/1991 | Finney | 220/522 |

*Primary Examiner*—Jimmy G. Foster

[57] ABSTRACT

A picnic sandwich box which includes a container portion and a cover for the container. The cover has pivotally side handles which releasably engage a flange extending around the upper rim of the container. The container has a compartment formed in its upper surface for receiving disposable utensils, such as a spoon and fork. A moveable partition is mounted in the container and extends transversely across the container to serve as a divider to enable it to hold different food, for example, or fruit. The cover is preferably made of transparent plastic material, and the container portion is made of appropriate microwavable plastic, to enable food in the container to be heated after the cover has been removed.

6 Claims, 2 Drawing Sheets

PICNIC SANDWICH BOX

BACKGROUND OF THE INVENTION

The invention is concerned with a compact rectangular box for sandwiches and other food, and which is particularly adapted for use on picnics, as well as for school lunches, and the like.

The box includes a rectangular container portion for the foods having side walls which define an open top, and the box also includes the rectangular cover for the container. The cover is equipped with a pair of pivotally mounted side handles which may be turned down over a flange extending around the rim of the container adjacent to its open top. When turned down, the handles serve to hold the cover firmly in place on the container, and they permit the cover easily to be removed by pulling the handles up and out from the sides of the container. The cover may subsequently be replaced on the container by snapping the handles down over the flange. The cover is preferably transparent.

The container may be equipped with a partition which extends transversely thereacross, and which is moveable along the length of the container to serve as a divider, thereby enabling the container to hold different sizes of food. The container may be formed of any appropriate plastic material. Preferably, the container is formed of a plastic which is capable of use in conjunction with a microwave oven to permit food in the container to be heated after the cover has been removed.

The cover is provided with an elongated compartment in its upper surface for receiving utensils, such as a disposable spoon and fork. A sliding member is provided for enclosing the compartment.

SUMMARY OF THE INVENTION

A picnic sandwich box is provided which includes a container having an open top, and a cover for the container. The cover includes pivotally mounted side handles which releasably engage a flange extending around the upper rim of the container. The handles enable the box conveniently to be opened, specially by children. The cover is preferably transparent. A compartment is provided in the top of the cover which serves, for example, to hold a disposable spoon and fork, or other utensils. A moveable partition is mounted in the container and extends transversely across the container. To be moved along the container and divide it into compartments. This partition enables the container to hold different foods or fruit.

DETAILED DESCRIPTION OF THE ILLUSTRATED EMBODIMENT

Figure 2:
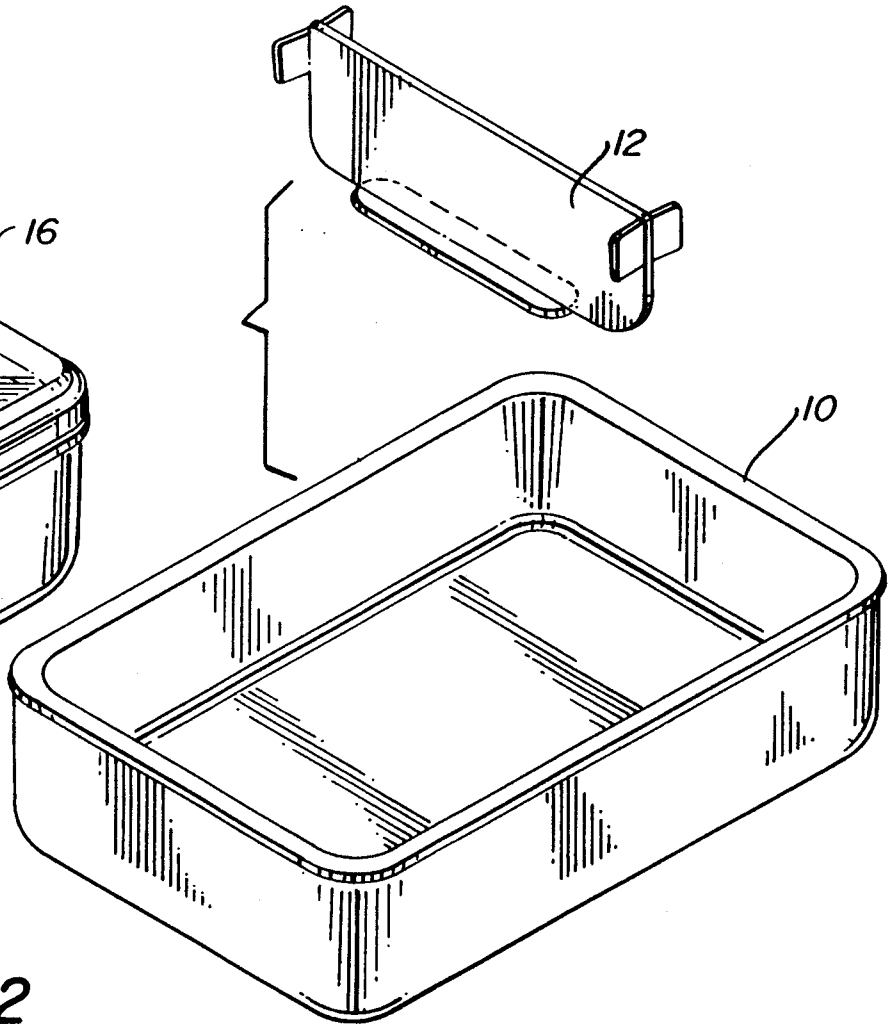
FIG. 2 is a view of the container portion of the box taken from the top, and also showing a partition member which is received within the container, and which is moveable along the container to adapt it to hold different sizes of food.
Figure 1:
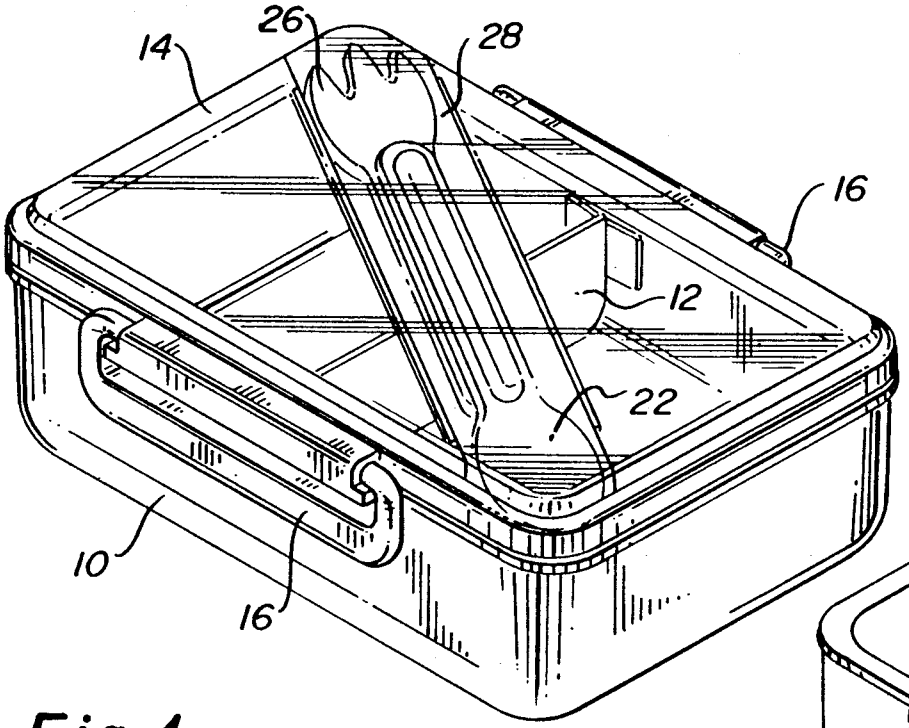
FIG. 1, is a perspective view of the box of the invention taken from the top and to one side.
Figure 4:
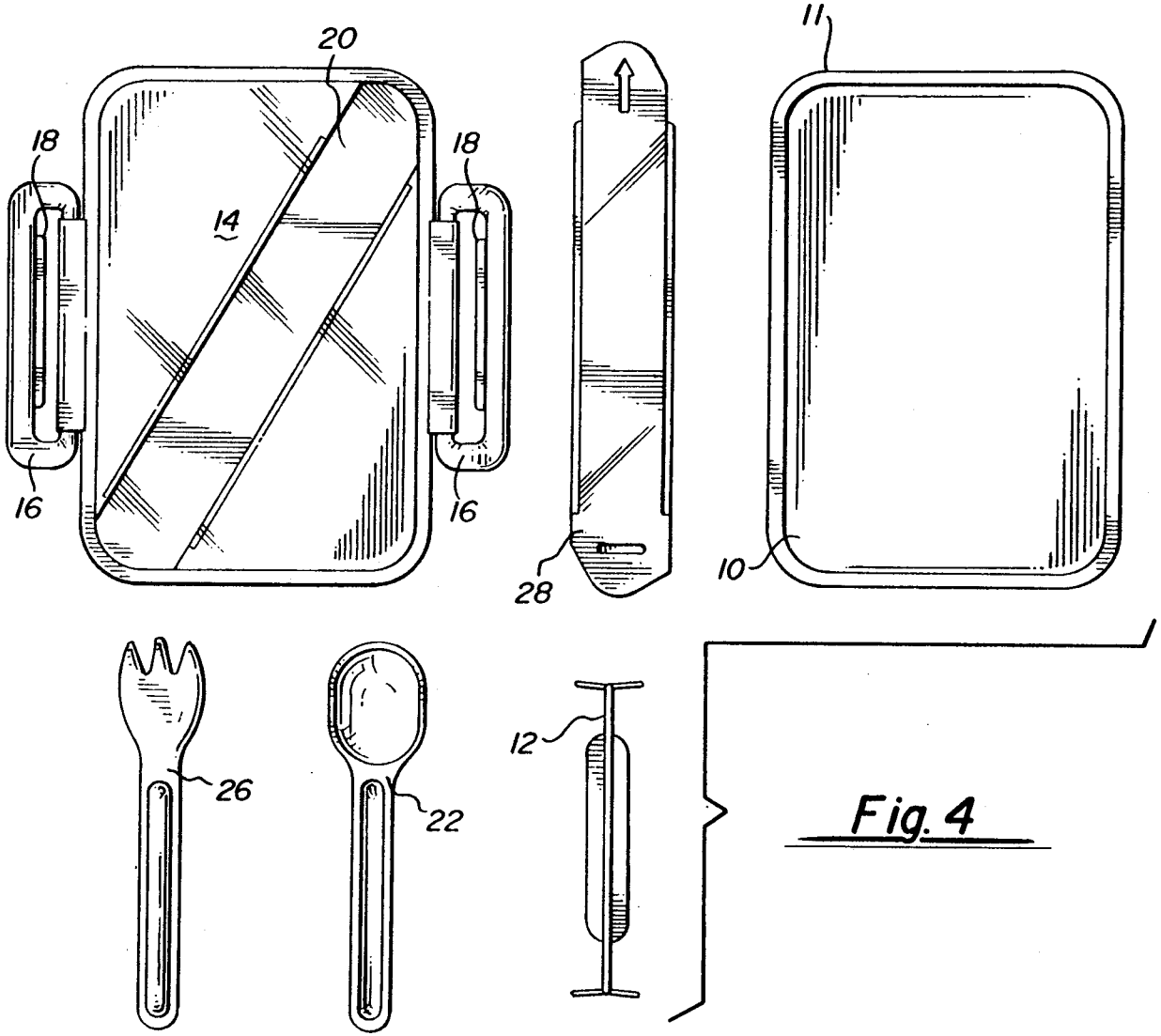
FIG. 4 is a perspective view showing the various components of the box of the invention.
Figure 3:
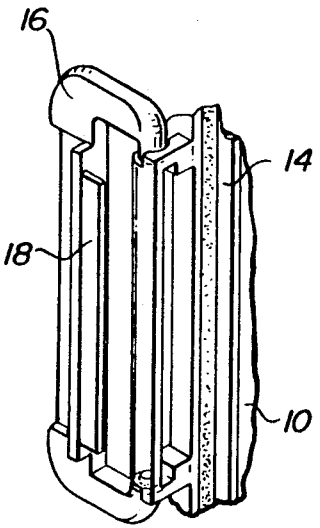
FIG. 3 is a perspective view of the box taken from the bottom and from one side, and showing the side handles of the covers partially open to release the cover from the container portion of the box.

As shown in FIGS. 1–4, the box of the invention comprises a container portion 10 of a rectangular configuration. The container has side walls which define an open top for the container, and which also define a flange 11 extending around the rim of the container adjacent to the open top. The container is also equipped with a partition 12 which extends transversely across the container. The partition 12 may be moved from one end of the container to the other to serve as a divider. This enables the container to be adapted to receive different sizes of food. The container 10 is preferably formed of microwavable material so that the food in the box may be heated after the cover has been removed.

The cover of the container 10 is designated 14, and is preferably formed of transparent plastic material so that the contents of the container may be viewed through the cover.

A pair of side handles 16 are pivotally mounted on opposite sides of the cover 14. These side handles are equipped with flanges 18 (FIG. 3) which snap over the flange 16 of container 10 when the handles 16 are turned down. In this way, the handles serve securely to hold the cover in place on the container, and yet they permit the cover to be easily released from the container, merely by turning the handles up to the position shown, for example, in FIG. 4.

An elongated compartment 20 is formed in the cover 14, and the compartment extends diagonally across the cover. The compartment 20 is intended to receive disposable utensils, such as a spoon 22, and a fork 26. A elongated member 28 is slidably mounted in the cover 14 to form an enclosure for compartment 20.

The invention provides, therefore, a convenient box for picnics or school lunches, or the like, which is compact and convenient to handle, and which may be readily opened, even by children. The box has a feature in that when it is closed, its cover is securely held in place. Also, the cover of the box is equipped for a compartment for receiving utensils, so that everything that is necessary may be easily accommodated in the box. As stated above, the container portion of the box is preferably made of microwavable plastic, so that the contents may be heated after the cover has been removed.

It will be appreciated that while a particular embodiment of the invention has been illustrated and described, modifications may be made. It is intended in the claims to cover all modifications which come within the true spirit and scope of the invention.

I claim:

1. A box for sandwiches, and other foods, comprising: a rectangular container portion having side walls defining an open top for said container and said container portion having a flange extending around the rim thereof adjacent to the open top, a rectangular cover for the container, and a pair of handles pivotally mounted to opposite sides of the cover and having respective flanges formed therein for releasably engaging the flange extending around the rim of the container.

2. The box defined in claim 1, in which the cover is formed of a transparent plastic material.

3. The box defined in claim 1, in which the cover has a compartment formed in the top surface thereof for receiving utensils.

4. The box defined in claim 3, and which includes a member slidably mounted on said cover for enclosing said compartment.

5. The box defined in claim 1, and which includes a partition movably mounted in said container and extending transversely thereacross to serve as an adjustable divider.

6. The box defined in claim 1, in which said container is formed of microwavable plastic material to permit the contents thereof to be heated after the cover has been removed.

* * * * *